US006752246B2

(12) United States Patent
Takai et al.

(10) Patent No.: US 6,752,246 B2
(45) Date of Patent: Jun. 22, 2004

(54) SPEED GOVERNOR AND ELEVATOR EMPLOYING THE SPEED GOVERNOR

(75) Inventors: Kazuhiko Takai, Tokyo (JP); Hidehiko Kobayashi, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 174 days.

(21) Appl. No.: 10/209,898

(22) Filed: Aug. 2, 2002

(65) Prior Publication Data

US 2003/0024771 A1 Feb. 6, 2003

(30) Foreign Application Priority Data

Aug. 3, 2001 (JP) ..... 2001-236746
Jul. 19, 2002 (JP) ..... 2002-211547

(51) Int. Cl.[7] ..... B66B 5/04

(52) U.S. Cl. ..... 187/373; 187/287; 187/305; 188/187

(58) Field of Search ..... 187/287, 305, 187/373; 188/187, 189, 184, 185

(56) References Cited

U.S. PATENT DOCUMENTS 4,006,799 A * 2/1977 Binder et al. ..... 187/305
4,556,155 A * 12/1985 Koppensteiner ..... 188/184
5,299,661 A * 4/1994 Pramanik et al. ..... 187/373

FOREIGN PATENT DOCUMENTS

GB 914474 A * 1/1963
JP 11-240677 9/1999

* cited by examiner

*Primary Examiner*—Eileen D. Lillis
*Assistant Examiner*—Thuy V. Tran
(74) *Attorney, Agent, or Firm*—Oblon, Spivak, McClelland, Maier & Neustadt, P.C.

(57) ABSTRACT

In a speed governor linkage mechanism that is displaced by centrifugal force acting on rotary weights, a balancing weight is provided in addition to speed adjustment spring for generating balancing force in opposition to the centrifugal force. When the speed of the cage is less than a prescribed speed, restraint of movement of the speed governor linkage mechanism is performed solely by the balancing force produced by balancing weight but when the speed of the cage exceeds said prescribed speed, restraint of movement of the speed governor linkage mechanism is performed by both the balancing force produced by the balancing weight and the balancing force produced by the speed adjustment spring.

8 Claims, 14 Drawing Sheets

SPEED GOVERNOR AND ELEVATOR EMPLOYING THE SPEED GOVERNOR

CROSS-REFERENCE TO RELATED APPLICATION

This application claims benefit of priority to Japanese Application number JP 2001-236746 filed Aug. 3, 2001, the entire content of which is incorporated by reference herein.

BACKGROUND OF THE INVENTION

1. Field of the Invention

The present invention relates to a speed governor that detects excessive traveling speed of an elevator cage or counterweight and to an elevator employing this speed governor.

2. Description of the Related Art

Article 129 No. 9(7) of Regulations made under regulation of the Japanese Building Standards Law specifies that, as a safety device in an elevator, there must be provided a device to automatically restrain descent of the cage if the speed of the descending cage exceeds a prescribed value.

FIG. 1 is a view showing diagrammatically the mechanism of a typical elevator provided with an emergency stop device. Elevator cage 101 is raised and lowered within an ascent/descent path (shaft) by means of a winding machine (hoist)(not shown) from which it is suspended by a main rope 102, its ascent/descent being guided by a guide rail 103 provided in the ascent/descent path. An emergency stop device 104 is mounted on cage 101. If the speed of elevator cage 101 exceeds the rated speed due to breakage of main rope 102 or abnormal increase of the speed of rotation of the winding machine, emergency stop device 104 mechanically stops cage 101 by gripping guide rail 103.

That is, when excessive speed of the elevator is detected by speed governor 105 provided in the mechanism chamber, a rope clamping element 106 incorporated in a speed governor 105 is actuated, causing speed governor rope 107 that passes over the sheave of speed governor 105 to be gripped. When speed governor rope 107 is gripped, emergency stop device 104 is actuated by means of a safety link 108 mounted on cage 101.

FIG. 2 shows a typical speed governor employed in a high-speed elevator. This speed governor is a type of centrifugal speed governor. When sheave 108 mounted on speed governor rope 107 is rotated, this rotation is transmitted by means of a rotary shaft 113 directed in the vertical direction, by means of gear wheel 112. First links 110A constituting part of speed governor linkage mechanism 110 are mounted on a rotary shaft 113 and rotary weights (flyweights) 109 are mounted at the tips of the link arms of first links 110A. When sheave 108 is rotated, the link arms on which rotary weights 109 are mounted are opened by centrifugal force C acting on rotary weights 109, thereby raising or lowering a shaft sliding sleeve mounted on rotary shaft 113. A support shaft of a second link 110B constituting another part of speed governor linkage mechanism 110 is mounted on the shaft sliding sleeve. Second link 110B is moved with displacement of the shaft sliding sleeve in the vertical direction and when the amount of displacement of the shaft sliding sleeve exceeds a prescribed value, a hook (not clearly shown in the drawing) provided at the end of the second link 110B is released from rope clamping element 106. Rope clamping element 106 thereby grips speed governor rope 107, causing the movement of speed governor rope 107 to be arrested.

When this happens, emergency stop device 104 is actuated by means of a safety link 108 mounted on cage 101 (see FIG. 1).

However, typically, in order to achieve stable operation and to prevent unwanted operation, the speed governor is adjusted such that the first and second links 110A and 110B i.e. speed governor linkage mechanism 110 are not operated until the rated operating speed of the elevator cage has been slightly exceeded. With this object, a speed adjustment spring 111 is provided on first link 110A; this speed adjustment spring ill generates a balancing force opposing centrifugal force C that acts on the rotary weights 109 at the rated speed of travel of elevator cage 101. Also, speed adjustment spring 111 is adjusted so as to generate a spring force such as to restrict the movement of speed governor linkage mechanism 110 such that second link 100B actuates rope clamping element 106 just when the speed of cage 101 exceeds the rated value.

The speed governor shown in FIG. 2 is called an "upright type" speed governor, since the rotary shaft 113 of rotary weights 109 is directed vertically upwards. In contrast, there are also available "horizontal type" centrifugal speed governors, in which the rotary shaft of the rotary weights is directed horizontally. An example of such is shown in FIG. 3. The construction of the speed governor shown in FIG. 3 can be understood by reference to the construction of the speed governor shown in FIG. 5, which is described in detail later, in the section "Detailed description of the preferred embodiments". The speed governor shown in FIG. 3 is described with the object of a comparative explanation of the technical effect with the speed governor according to the present invention in the section "Detailed description of the preferred embodiments" later; it is not the case that the entire construction of the speed governor shown in FIG. 3 is publicly known.

In the upright type centrifugal speed governor shown in FIG. 2, in order to convert the rotation of sheave 108 about a horizontal axis into rotation about a vertical axis it is necessary to provide a gear wheel 112. This has the drawback that the mechanism becomes complicated and the number of components are increased. On the other hand, since the mass of rotary weights 109 and/or link mechanism 110A acts as a balancing force opposing the centrifugal force C acting on centrifugal weights 109, there is the advantage that operation of the speed governor can be restrained by these masses.

In contrast, in the case of the horizontal type of centrifugal speed governor shown in FIG. 3, since the rotary shaft of rotary weights 19 and the rotary shaft of the sheave can be shared, a mechanism such as a gear wheel is unnecessary. The number of components can therefore be decreased compared with the upright type. Also, since the rotary shaft of sheave 11 rotates the rotary weights directly, there is the advantage that the speed governor operates linearly in respect of changes of speed of movement of the elevator i.e. the advantage that precision of the speed governor is increased. However, since the pair of rotary weights 19 and the links 16 associated therewith are arranged in a condition with their weights balanced about rotary shaft 13, the mass of rotary weights 19 and/or link 16 and the like does not act as a balancing force opposing centrifugal force C. There is therefore the disadvantage that movement of the speed governor linkage mechanism must be restrained i.e. controlled solely by means of the spring force generated by speed adjustment spring 26.

The magnitude of the centrifugal force C acting on the rotary weights is expressed in the form:

$$C=mr\omega^2=mv^2/r$$

where C is the centrifugal force, m is the mass of the rotary weights, r is the radius of rotation of the rotary weights, ω is the angular velocity of the rotary weights and v is the elevator speed.

As can be seen from this equation (expression), the centrifugal force C is proportional to the square of the rotational speed. In recent years, very high-speed elevators of rated speed surpassing 600 m/min have appeared. In the speed governors of such high-speed elevators, as shown in FIG. 4, not only the magnitude of the centrifugal force C itself acting on the rotary weights but also the range of the centrifugal force C (i.e. the difference of the centrifugal force at the rated speed and the centrifugal force under excess speed conditions under which the emergency stop device would be expected to be actuated) is much greater than in a conventional elevator. Consequently, a speed governor is required having a function of being able to control in a reliable fashion actuation of the speed governor linkage mechanism and rotary weights, over a wide range of speeds.

That is, as the rated operating speed of the elevator becomes higher, the centrifugal force in the narrow range of speeds between commencement of operation of the speed governor linkage mechanism and actuation of the emergency stop device increases abruptly. In order to obtain stable performance, the spring constant of the speed adjustment spring must therefore be made small so that the change of controlling force for opposing the centrifugal force is made gradual.

On the other hand, since the speed of commencement of operation of the speed governor linkage mechanism is also high, the centrifugal force C when operation of the speed governor linkage mechanism commences also becomes high and the balancing force needed to restrain operation of the speed governor linkage mechanism also becomes large. Consequently, in a centrifugal speed governor of the horizontal type in which the mass of the rotary weights and/or speed governor linkage mechanism and the like does not act in opposition to the centrifugal force C, a speed adjustment spring capable of generating a large force is necessary.

Consequently, in a horizontal type centrifugal speed governor, a speed adjustment spring is needed that has a small spring constant and that is capable of generating a large balancing force. This means that a speed adjustment spring of extremely large external dimensions becomes necessary. This makes it impossible to construct a speed governor in a restricted space. Also, even if such a governor could be constructed, since the spring constant of the speed adjustment spring is small, the effects of manufacturing errors of the speed adjustment spring and/or individual differences of the speed governors would be considerable, making it impossible to provide a speed governor of stable performance.

SUMMARY OF THE INVENTION

Accordingly, one object of the present invention is to provide a novel speed governor of the horizontal type of excellent ease of manufacture and maintainability and high reliability, wherein the speed adjustment spring and speed governor main body can be made of small size and an elevator employing the speed governor.

In order to achieve this object, the present invention is constituted as follows. Specifically, according to the invention there is provided an elevator speed governor comprising:

a rope clamping element capable of gripping a speed governor rope for actuating an emergency stop device provided on the cage of an elevator;

a sheave that rotates with a speed corresponding to the speed of the cage, being engaged by the speed governor rope;

a rotary weight that rotates about an axis of rotation directed horizontally, being linked with rotation of the sheave and that is displaced by centrifugal force so as to move away from the axis of rotation;

a speed governor linkage mechanism on which the rotary weight is mounted and that is moved with displacement of the rotary weight and that actuates the rope clamping element if its movement exceeds a prescribed range;

a speed adjustment mechanism provided in the speed governor linkage mechanism that is displaced with movement of the speed governor linkage mechanism and that generates a first balancing force that restrains movement of the speed governor linkage mechanism by resilient force generated in accordance with the amount of this displacement; and a balancing weight provided in the speed governor linkage mechanism and that loads the speed governor linkage with a second balancing force produced by weight acting on this balancing weight that restrains movement of the speed governor linkage mechanism.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
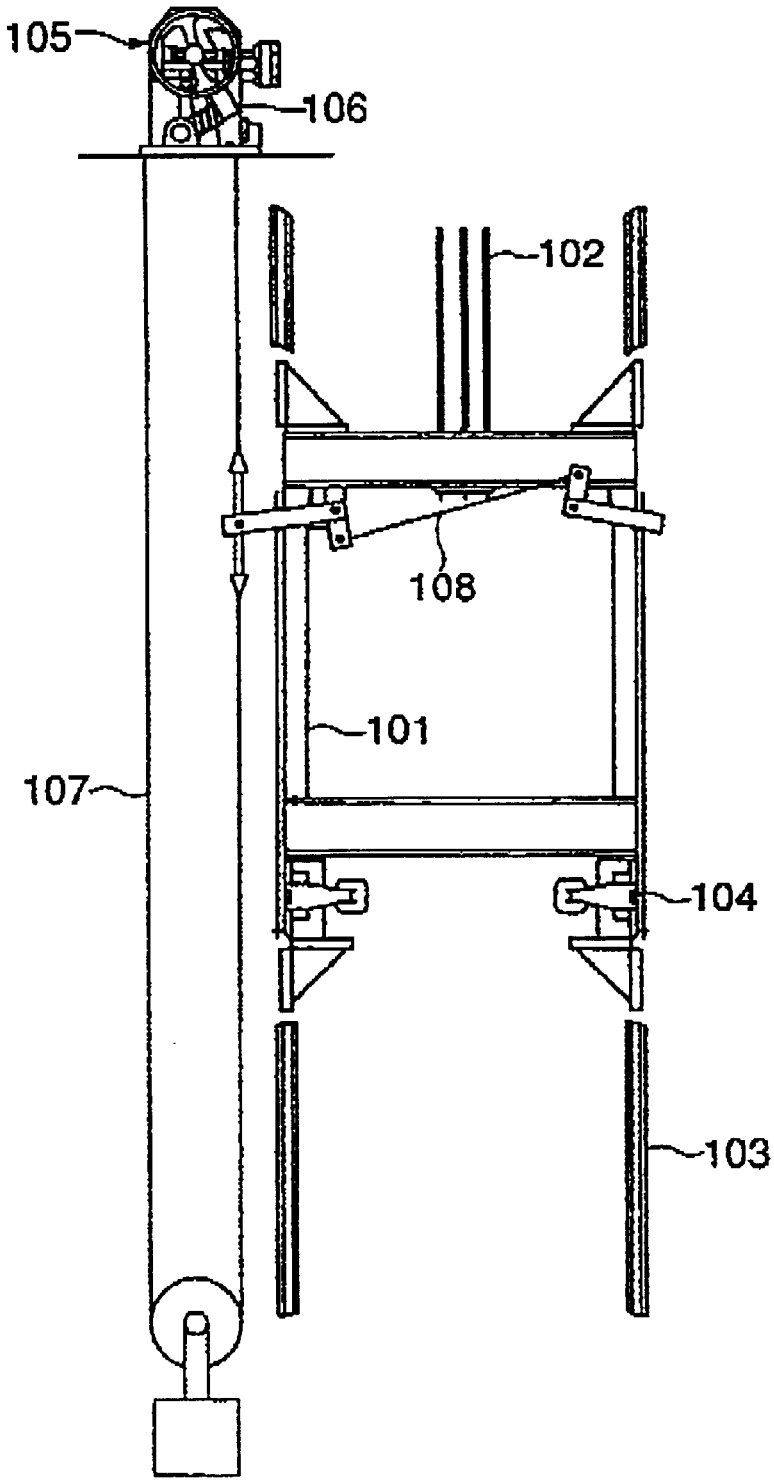
FIG. 1 ( PRIOR ART )
FIG. 1 is a diagrammatic layout view of a typical elevator.

Referring now to the drawings, wherein like reference numerals designate identical or corresponding parts throughout the several views, and more particularly to FIG. 5 thereof, one embodiment of the present invention will be described.

[First Embodiment]

Figure 5:
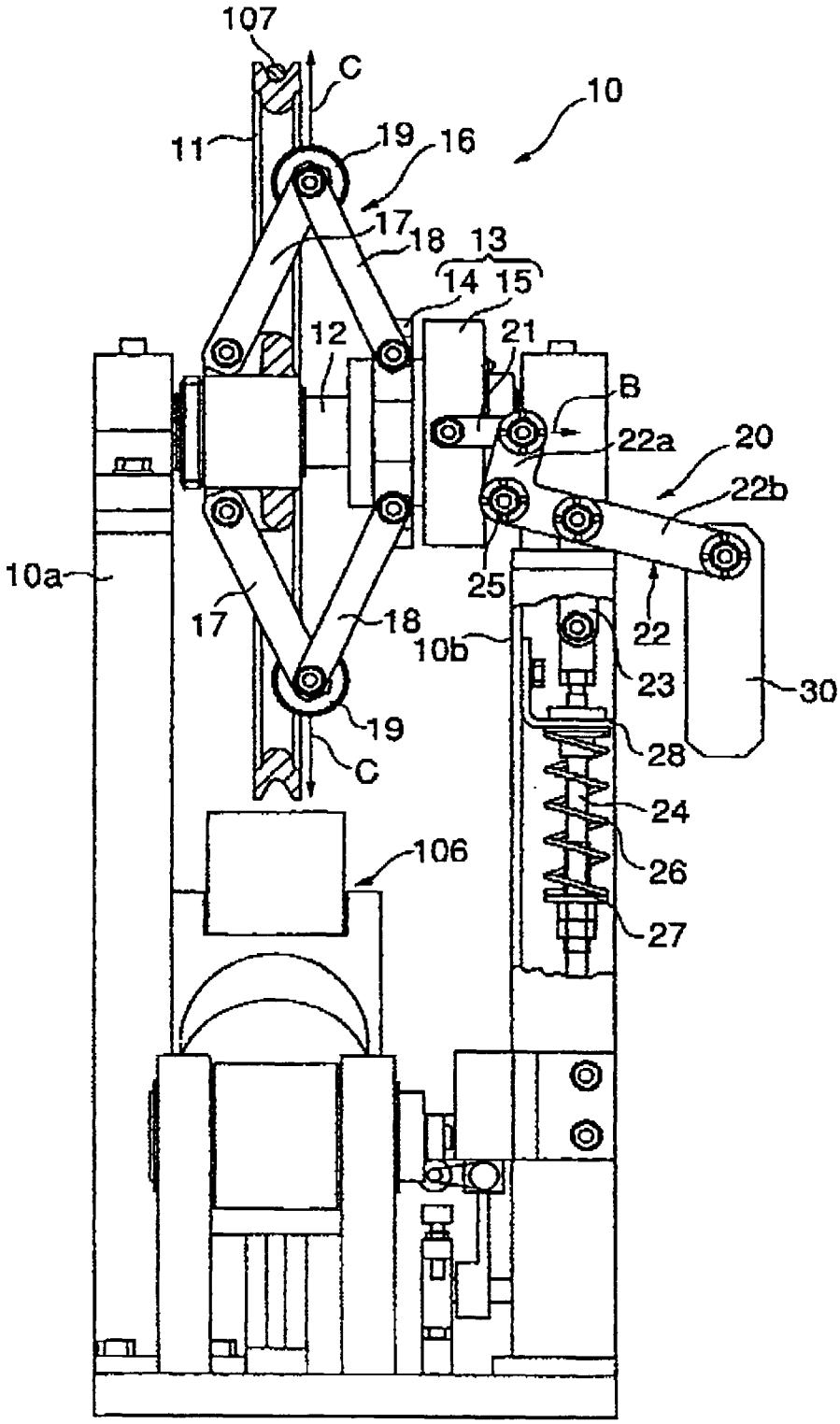
FIG. 5 is a view showing a first embodiment of an elevator speed governor according to the present invention.

FIG. 5 is a view illustrating a first embodiment of a speed governor according to the present invention. This speed governor 10 could be provided on an elevator instead of the speed governor 105 shown in FIG. 1. Speed governor 10 comprises a sheave 11 on which is wound a speed governor rope 107. Sheave 11 is rotated with the speed of movement of speed governor rope 107 i.e. a speed corresponding to the cage speed, about a rotary shaft 12 arranged in the horizontal direction. Rotary shaft 12 is supported in the horizontal direction on support pillars 10A, 10B.

On rotary shaft 12, a coupling 13 is mounted so as to be moveable in the axial direction of rotary shaft 12. Coupling 13 comprises a first tubular body 14 that is capable of movement in the axial direction of rotary shaft 12 and that rotates together with rotary shaft 12 and a second tubular body 15 that is capable of movement in the axial direction of rotary shaft 12 together with first tubular body 14 and that is capable of relative rotation with respect to first tubular body 14 (i.e. that does not rotate even though first tubular body 14 does rotate).

On rotary shaft 12 and first tubular body 14 there are mounted first links 16 constituting part of the speed governor linkage mechanism. First links 16 comprise arms 17 and 18 that are coupled so as to make V shapes. Rotary shaft 12 is pivoted at one end of arms 17. First tubular body 14 is pivoted at one end of arms 18. The other end of arms 17 and 18 are coupled so as to be capable of relative rotation of arms 17 and 18, and rotary weights (flyweights) 19 are mounted at the points of coupling of arms 17 and 18. Two sets of arms 17, 18 and rotary weights 19 are provided in symmetrical positions with respect to rotary shaft 12. Consequently, no matter what the rotational position of rotary shaft 12 is, the mass of arms 17, 18 and rotary weights 19 cannot act so as to displace coupling 13 in the axial direction of rotary shaft 12. This is the characteristic feature of a "horizontal type" speed governor as described above.

When rotary weights 19 are rotated by rotation of rotary shaft 12 of sheave 11, rotary weights 19 are displaced outwards in the radial direction of rotary shaft 12 by the centrifugal force acting on rotary weights 19. Concomitantly with this, arms 17 and 18 that constitute the first link mechanism 16 are displaced in the closing direction, thereby displacing coupling 13 in the leftwards direction of FIG. 5.

One end of a second link 20 constituting part of the speed governor linkage mechanism is coupled to second tubular body 15. Second link 20 is a link that transmits the motion of second tubular body 15 to an arm (not shown in detail in FIG. 5) that actuates rope clamping element 106 by releasing the hook of rope clamping element 106. Second link 20 comprises arm 21, L-shaped arm 22, arm 23 and rod 24.

Figure 2:
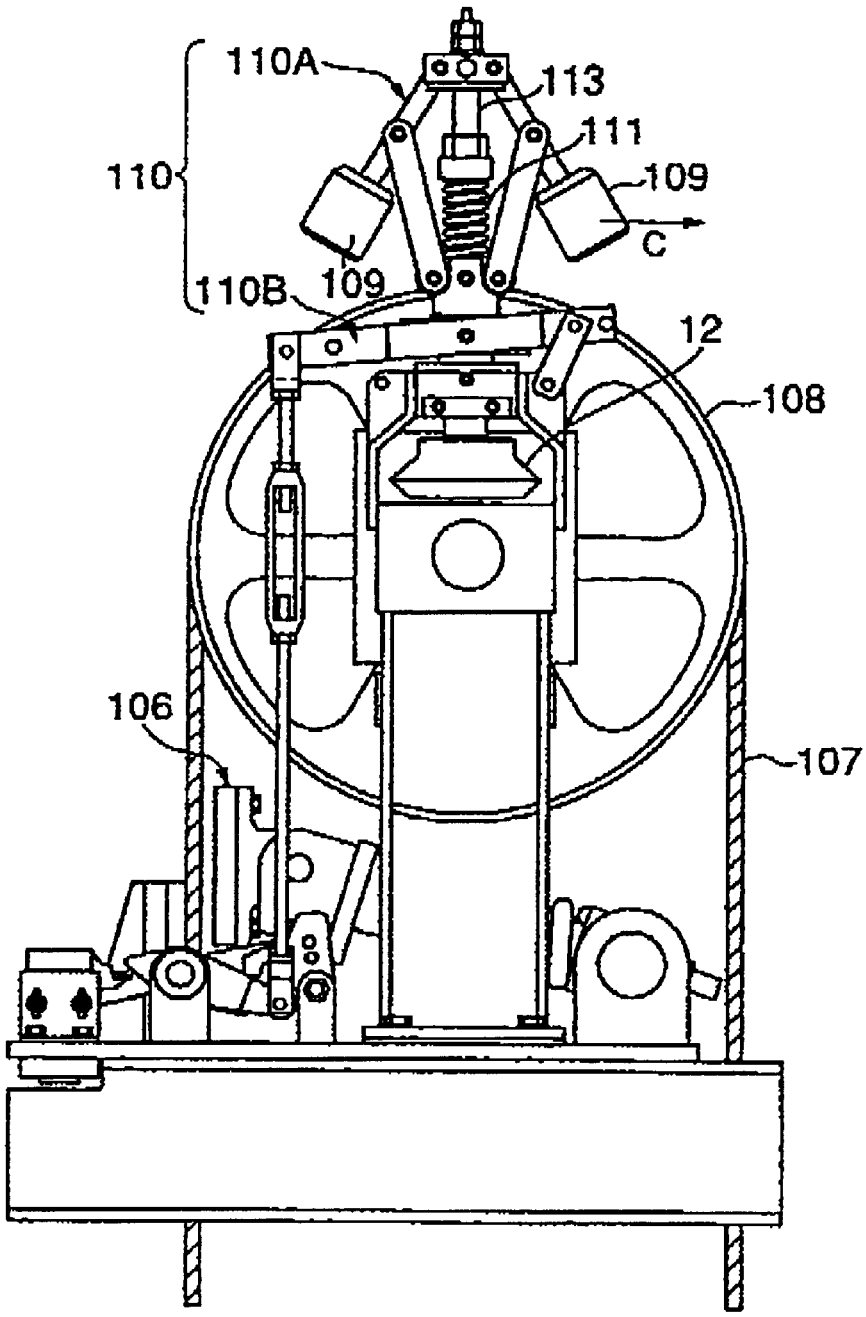
FIG. 2 ( PRIOR ART )
FIG. 2 is a view showing an example of a typical upright type speed governor.

Below rod 24, second link 20 is provided with an arm for releasing the hook of rope clamping element 106 and/or an arm (this is not clearly shown in the drawings) for kicking a limit switch. However, since the construction of this portion has no direct relationship with the essence of the present invention, description thereof in this specification is omitted. For this portion, any desired known construction could be adopted by those skilled in the art: for example the construction shown in the lower part of FIG. 2 could be employed.

L-shaped arm 22 of second link 20 is capable of rocking movement about an immovable shaft 25 fixed to support pillar 10*b*. One end at the tip of first side 22*a* of L-shaped arm 22 is pivoted to the other end of arm 21 that is pivoted to second tubular body 15. Balancing weight 30 is pivoted at the tip of second side 22*b* of L-shaped arm 22. One end of arm 23 is pivoted between the tip of second side 22*b* of L-shaped arm 22 and shaft 25. The other end of arm 23 is pivoted to one end (top end) of rod 24. Rod 24 is capable of movement only in the perpendicular direction. Consequently, when rotary weights 19 are displaced by centrifugal force, rod 24 is displaced upwards in the vertical direction.

Rod 24 is accommodated in the interior of support pillar 10*b*. Speed adjustment spring 26 is mounted on rod 24. A seat 27 that seats the bottom end of speed adjustment spring 26 is provided on rod 24. An immovable seat 28 facing seat 27 is mounted on support pillar 10*a*. Consequently, when rod 24 is displaced upwards, speed adjustment spring 26 is compressed, causing speed adjustment spring 26 to thereby displace rotary weights 19 i.e. force is generated in the direction such as to restrain movement of a first link 16 and second link 20.

As described above, in order to perform operation in stable fashion and to prevent unwanted operation, the speed governor linkage mechanism of the speed governor is preferably constructed so as not to operate until the rated speed of movement of the elevated cage is slightly exceeded. Suitably, therefore, the weight of balancing weight 30 is set to a value at which the centrifugal force acting on rotary weights 19 when the elevator cage is moving with a speed slightly exceeding the rated speed of movement and the balancing force generated by balancing weight 30 are roughly in equilibrium, taking into account the arrangement and the dimensions of the links.

In this specification, for convenience in description, the speed governor linkage mechanism including the speed governor was described divided into the portion (first link 16) that rotates together with rotary shaft 12 and the portion that does not rotate (second link 20); however, when, in this specification, reference is simply made to the "speed governor linkage mechanism" the entire link mechanism is meant, comprising the first and second links 16, 20 and coupling 13 that mutually couples these links 16 and 20.

Next, the action of the speed governor shown in FIG. 5 will be described with comparative reference to the comparative example shown in FIG. 3, to which the present invention is not applied. The difference between the speed governor of FIG. 5 and that shown in FIG. 3 lie in the provision of a balancing weight 30 at the tip of second side 22*b* of L-shaped arm 22.

In the speed governor shown in FIG. 3 and the speed governor shown in FIG. 5, the centrifugal force C acting on rotary weights 19 and the balancing force B opposing this can be expressed as follows.

Figure 3:
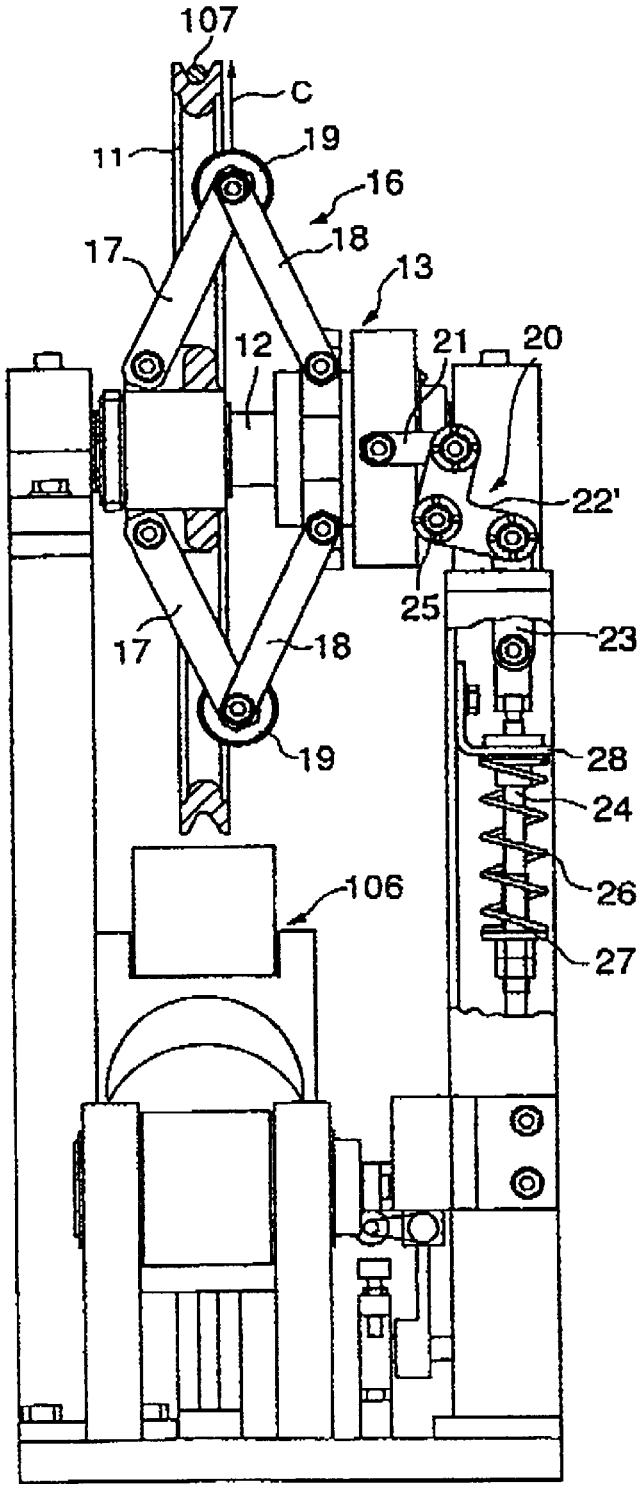
FIG. 3 ( PRIOR ART )
FIG. 3 is a view showing an example of the construction of a horizontal type speed governor.
Figure 4:
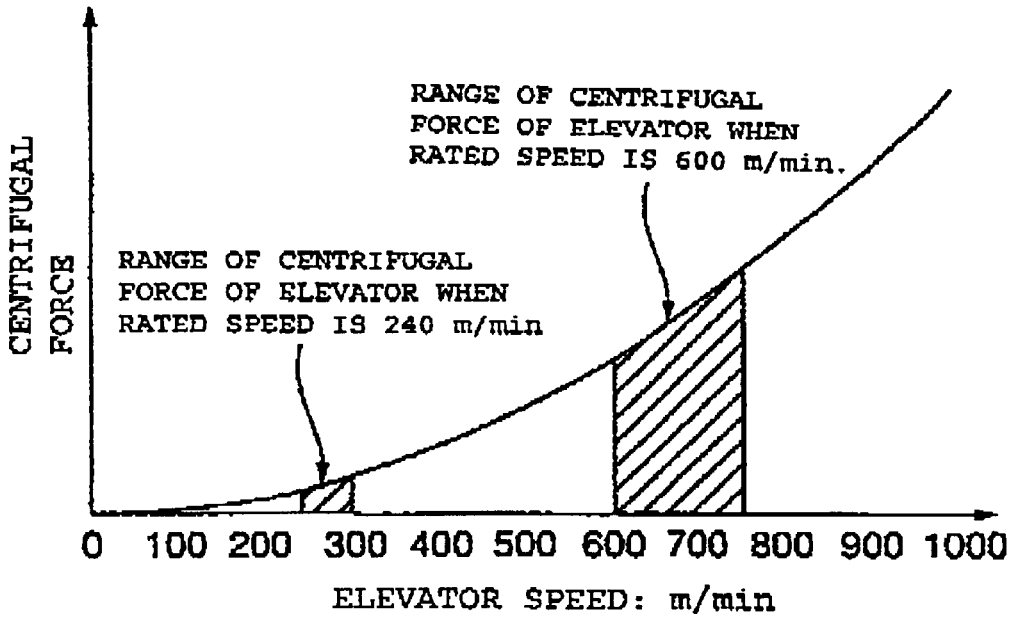
FIG. 4 ( PRIOR ART )
FIG. 4 is a view showing the centrifugal force generated by rotary weights of a speed governor.

Speed governor of FIG. 3:

$$C=2B\tan\alpha=2PS\tan\alpha$$

Speed governor of FIG. 5:

$$C=2B\tan\alpha=2(PB+PS)\tan\alpha$$

where PS is the balancing force produced by speed adjustment spring 26;

PB is the balancing force produced by balancing weight 30; and $\alpha$ is the angle made by rotary shaft 12 with arm 17 on which rotary weight 19 is mounted.

Figure 6A:
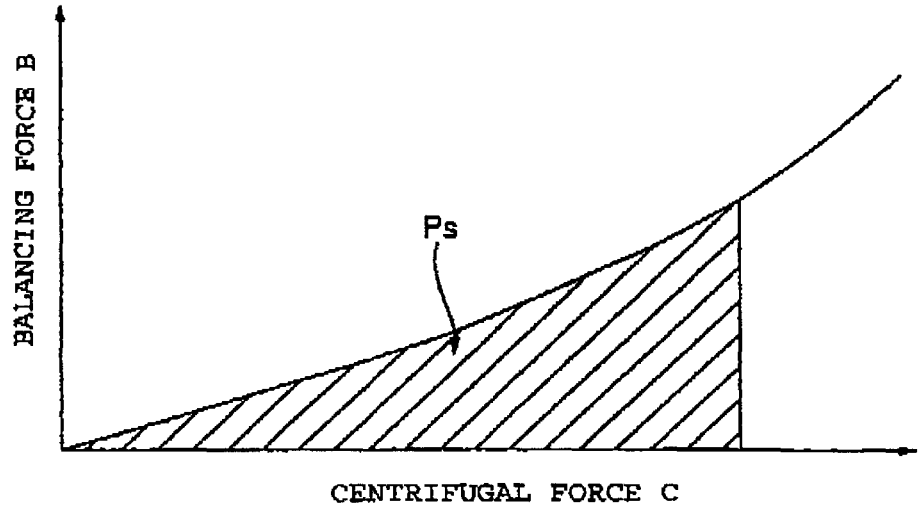
FIG. 6A and FIG. 6B are graphs given in explanation of the differences of action of the speed governors shown in FIG. 2 and FIG. 5.
Figure 6B:
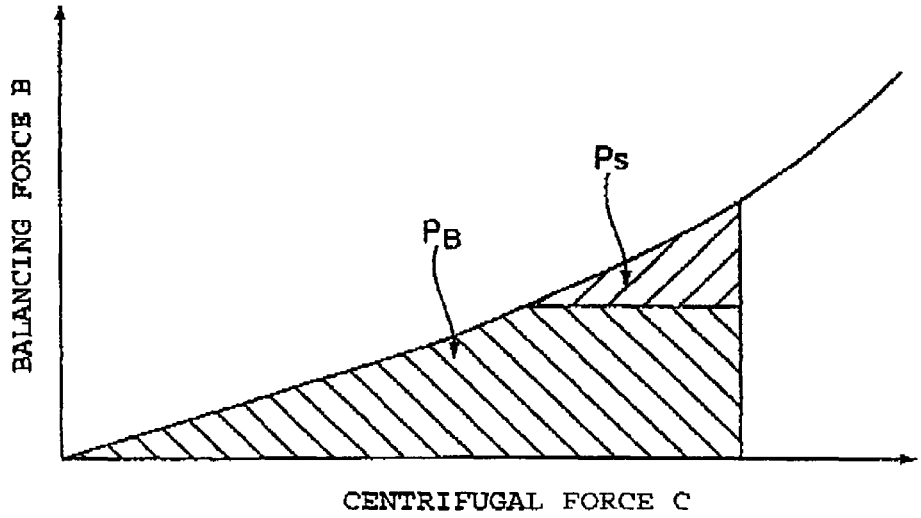

FIG. 6A and FIG. 6B respectively show the relationship between the centrifugal force C acting on rotary weights 19 in the speed governor shown in FIG. 3 and the speed governor shown in FIG. 5 with the balancing force B opposing this centrifugal force C. It should be noted that the relationship shown in FIG. 6A and FIG. 6B is diagrammatic only; the actual relationship is more complex due to dependence on the rocking angle of the L-shaped arm on which balancing weight 30 is mounted.

As shown in FIG. 6A, in the case of the speed governor of FIG. 3, in the entire speed region of the cage, the necessary balancing force B is provided solely by the balancing force PS generated by the speed adjustment spring 11, i.e. irrespective of the magnitude of the centrifugal force C.

In contrast, as shown in FIG. 6B, with the speed governor of FIG. 5, if the cage speed is less than a prescribed speed (specifically, this prescribed speed is a speed slightly higher than the rated speed), the necessary balancing force B is provided solely by the balancing force PB generated by the balancing weight 30, but, above this prescribed speed (in this case, when movement of the speed governor linkage mechanism starts), the necessary balancing force B is provided by both the balancing force PB generated by balancing weight 30 and the balancing force PS generated by speed adjustment spring 11.

As can be understood from FIG. 6A and FIG. 6B, with the speed governor of FIG. 3, since the speed adjustment spring 26 has to generate all of the balancing force B opposing the centrifugal force C acting on rotary weights 19 over the entire speed region of the cage (speed region from speed 0 up to the prescribed speed at which the emergency stop device must operate), as described in the section "Description of the Related Art" above, the problem occurs that the speed regulating spring 26 becomes of large size.

Also, since speed adjustment spring 26 must generate all of the balancing force B, a speed adjustment spring 26 capable of generating a large force becomes necessary also giving rise to the problem of increase in size of the retaining element (seat) of the speed adjustment spring 26. It therefore becomes difficult to accommodate the speed governor in a defined space.

However, with the speed governor of FIG. 5, since the necessary balancing force for restraining the starting off of the speed governor linkage mechanism is generated by balancing weight 30, speed adjustment spring 26 need only generate a balancing force sufficient to control the operating speed of the speed governor linkage mechanism, so the speed adjustment spring 26 can be made of small size. Also, a robust spring retaining element becomes unnecessary. As a result, the speed governor main body can be reduced in size.

[Second Embodiment]

Figure 7:
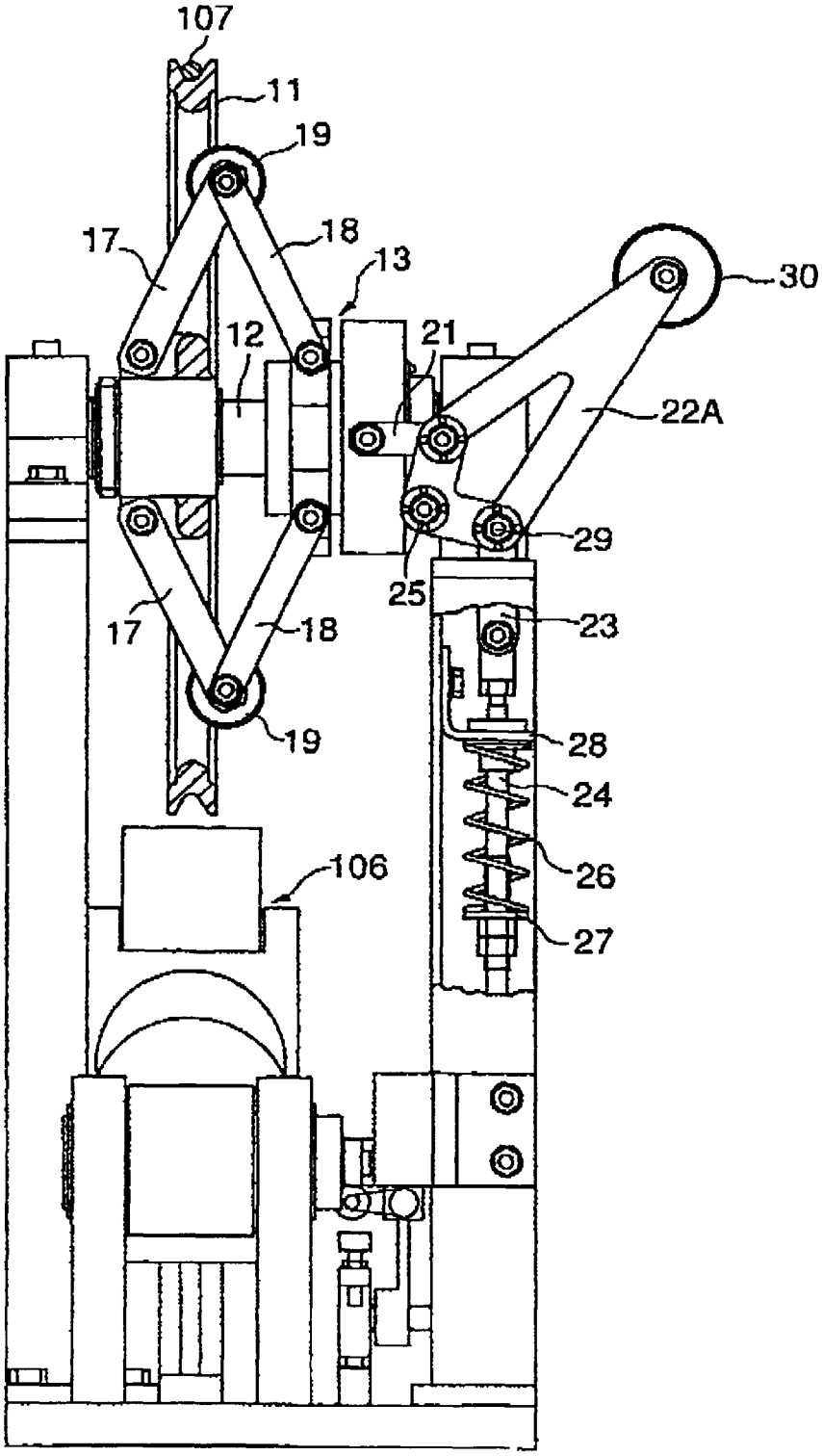
FIG. 7 is a view illustrating a second embodiment of an elevator speed governor according to the present invention.
Figure 8:
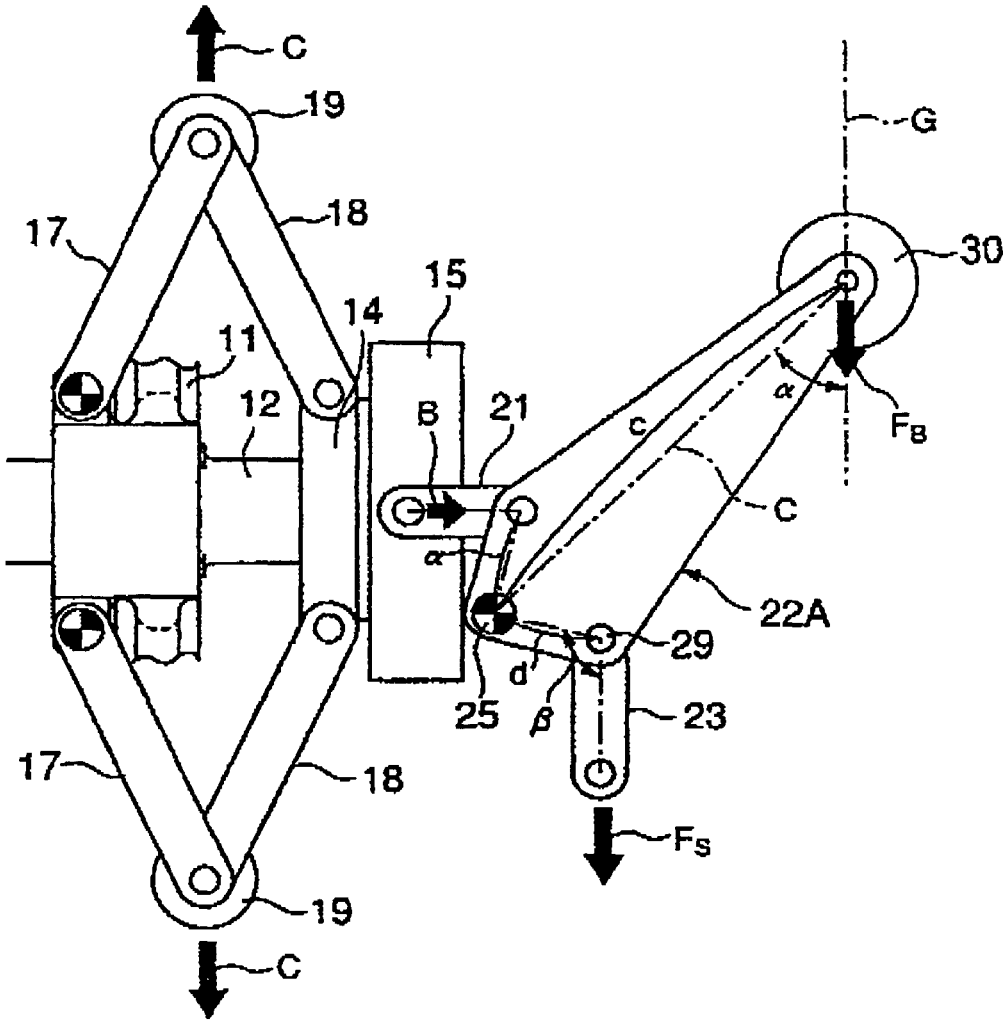
FIG. 8 is a view illustrating the action of the speed governor illustrated in FIG. 7.

Next, a second embodiment will be described with reference to FIG. 7 to FIG. 9. The main difference of the second embodiment compared with the first embodiment shown in FIG. 5 is that L-shaped arm 22 is substituted by another type of arm 22A in order to constitute a speed governor linkage mechanism such that the balancing force generated by balancing weight 30 becomes smaller with increase in the amount of displacement of the speed governor linkage mechanism; otherwise it is the same as the first embodiment. In FIG. 7 and FIG. 8 illustrating the construction of the second embodiment, portions which are the same as the FIG. 5 illustrating the first embodiment are given the same reference symbols and description thereof is not repeated.

Figure 9:
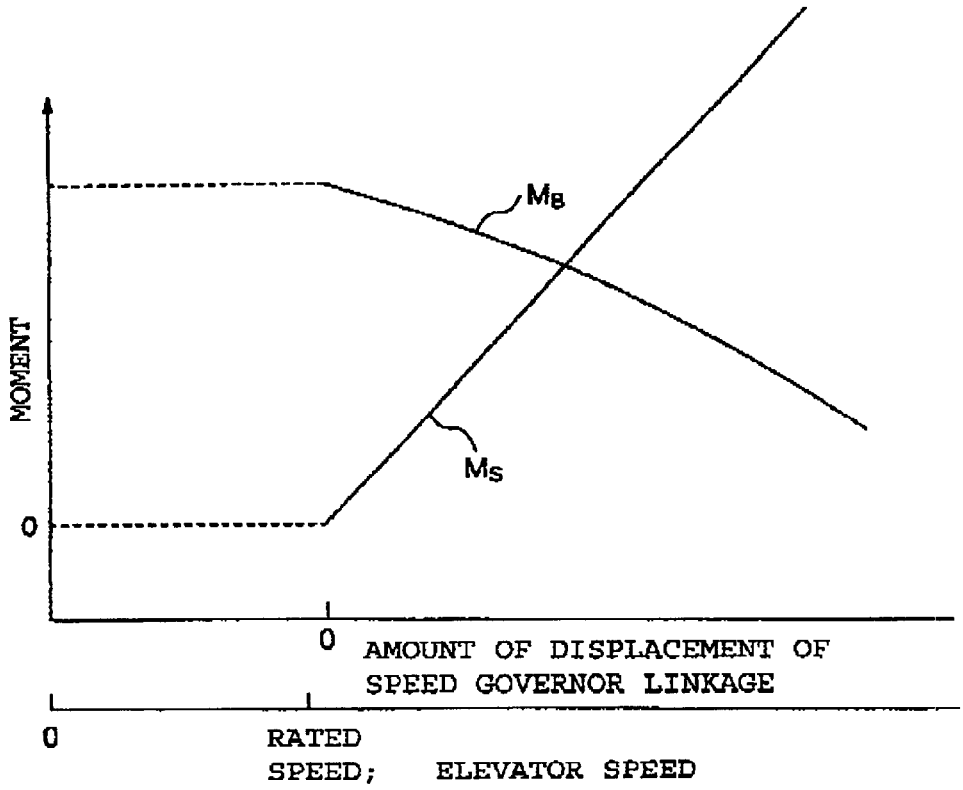
FIG. 9 is a graph illustrating the technical effects of the construction of the speed governor of FIG. 7.

The following description will refer to FIG. 8 illustrating major parts of the present embodiment and to the graph of FIG. 9 illustrating the action of the present embodiment.

As shown in FIG. 5, in the present embodiment, the speed governor linkage mechanism is constructed so as to satisfy the following conditions (1) and (2).

(1) Irrespective of the condition of the speed governor linkage mechanism, the angle $\alpha$ made by the straight line G that coincides with the direction of the weight acting on balancing weight 30 and the straight line C connecting the center of gravity of balancing weight 30 and shaft 25 is always an acute angle. (However, it should be noted that, in the case of the speed governor of FIG. 5, the angle $\alpha$ when the amount of displacement of the speed governor linkage mechanism is 0 is an obtuse angle but subsequently shifts to an acute angle.) That is, the balancing force generated by balancing weight 30 becomes smaller with increase in the amount of displacement of the speed governor linkage mechanism.

(2) The angle $\beta$ made by a straight line in a direction coincident with the direction of the force that is applied to the pivot point 29 by arm 23 due to the balancing force FS generated by speed adjustment spring 26 and the straight line joining shaft 25 and pivot point 29 of arm 22A and arm 23 shifts to the vicinity of 90°.

The balancing force B generated by speed adjustment spring 26 and balancing weight 30 can be expressed as follows.

$$B = (d/a)\,FS\,\lambda S + (c/a)FB\,\lambda B$$

$$= (d/a)\,k\delta\lambda S + (c/a)FB\,\lambda B$$

where

FS is the balancing force [N] generated by speed adjustment spring 26; 'FB is the balancing force (gravity acting on the balancing weight) [N] generated by balancing weight 30;

$\lambda$S is the linking efficiency relating to the speed adjustment spring linkage section;

$\lambda$B is the linking efficiency relating to the balance weight linkage section;

a is the distance [m] between shaft 25 and pivot point of arm 22A and arm 21;

c is the distance [m] between shaft 25 and the point where balance weight 30 is fixed on arm 22A;

d is the distance [m] between shaft 25 and pivot point of arm 22A and arm 23;

k is the spring constant [N/m] of speed adjustment spring 26; and $\delta$ is the displacement [m] of speed adjustment spring 26 generated by movement of the speed governor linkage mechanism.

The value of the linking efficiency $\lambda$ is a value determined by displacement of arm 22A (swiveling angle of arm 22A) and changes with movement of the speed governor linkage mechanism. The speed governor of the present embodiment is constructed so as to satisfy the above condition (2), so there is little change of the linking efficiency $\lambda$S relating to the linkage section of speed adjustment spring 26 resulting from movement of the speed governor linkage mechanism and, since this is constructed so as to satisfy above condition (1), the linking efficiency AB relating to the balance weight linkage section decreases with increases in displacement of the speed governor linkage mechanism.

The relationship between the amount of displacement of the speed governor linkage mechanism and the moment Mb about shaft 25 supplied to arm 22A by the gravity acting on balance weight 30 and the moment Ms about shaft 25 supplied to arm 22A by the spring force generated by speed adjustment spring 26 is therefore the relationship as shown diagrammatically in FIG. 9.

Specifically, as shown in FIG. 9, the balancing force generated by speed adjustment spring 26 increases with increase in the amount of displacement of the speed governor linkage mechanism, but the balancing force produced by balance weight 30 becomes smaller. Consequently, even if a speed adjustment spring 26 of large spring constant is employed, a characteristic similar to that when a spring of small spring constant is employed can be obtained, Thus, with the present embodiment, even in the case of a speed governor in particular for a very high-speed elevator that needed to have a speed adjustment spring 26 with small spring constant, a speed adjustment spring 2G with large spring constant can be employed. Reduction in the size of speed adjustment spring 26 and consequently reduction in size of the speed governor as a whole can therefore be achieved. Also, manufacture of speed adjustment spring 26 is facilitated. Furthermore, since the effect of manufacturing errors of the spring constant can be made small, manufacture of a speed governor of stable performance can be achieved.

Also, in the present embodiment, the shape of balance weight 30 is made a rotationally symmetric shape such as a cylindrical or spherical shape, being a construction fixed to arm 22A of the speed governor linkage by a rotationally symmetric shaft thereof. Thus there is no change in the positional relationship of arm 22A and the center of gravity of balance weight 30 (i.e. the center of gravity of balance weight 30 is always at a fixed point with respect to arm 22A) even if balance weight 30 performs rotary movement with movement of the speed governor linkage, so that there is no possibility of unwanted force being generated at the speed governor linkage even if balance weight 30 does not rotate freely with respect to the speed governor linkage. Design of the speed governor linkage is thereby facilitated and it becomes possible to generate a balancing force that changes in stable fashion by using balancing weight 30. Furthermore, since it is not necessary that balancing weight 30 itself should rotate, balancing weight 30 can be simply fixed to the speed governor linkage without needing to employ components such as bearings at the location where balancing weight 30 is fixed so ease of manufacture and maintainability are improved.

Figure 10:
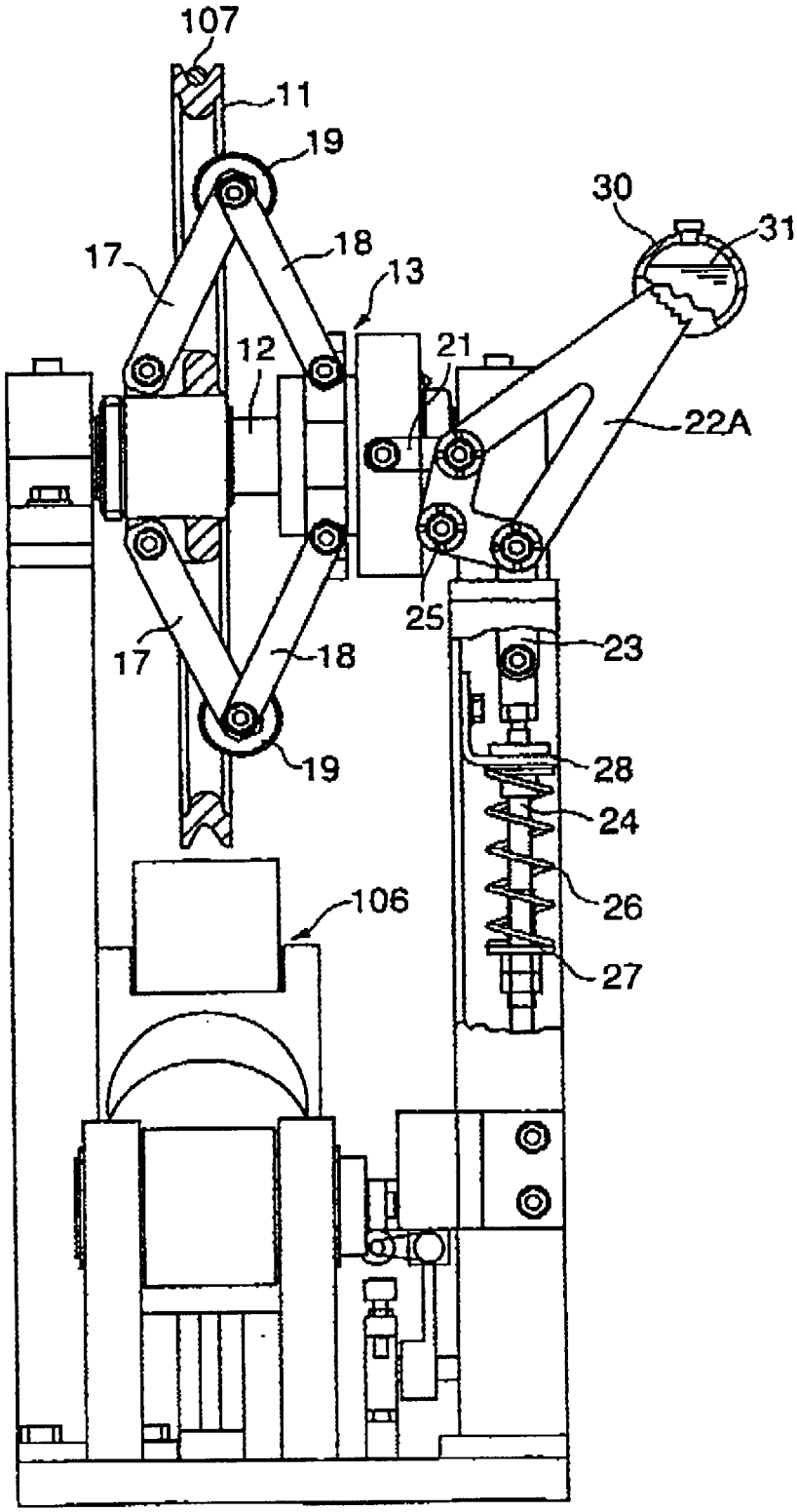
FIG. 10 is a view illustrating a modified example of the speed governor shown in FIG. 7.

It should be noted that, as shown in FIG. 10, balancing weight 30 could be made hollow and the mass of balancing weight 30 adjusted as desired by sealing an arbitrary quantity of liquid such as oil or sealed-in bodies 31 such as metallic granules within balancing weight 30. By employing such a balancing weight 30, if it is necessary to adjust the mass of balancing weight 30 on adjustment of the speed governor, this can be achieved simply by adjusting the amount of bodies 31 sealed into the interior thereof without needing to remove balancing weight 30 itself from the speed governor linkage mechanism and replace it, so the adjustment task can be facilitated. Also, since the need to process the mass of balancing weight 30 precisely and the need to manufacture balancing weights 30 of various different masses are eliminated, costs can be reduced.

Furthermore, by sealing a fixed amount of liquid into the interior of balancing weight 30 and making it possible for this liquid to move within the interior of balancing weight 30, an anti-vibration function can be conferred on balancing weight 30. That is, when the speed governor has assumed an unstable condition and the speed governor linkage mechanism has assumed an abnormal vibration condition, since the inertia of the bodies sealed into the interior of balancing weight 30 acts in a direction such as to cancel the vibration, attenuation and suppression of abnormal vibration can be achieved, enabling the speed governor to shift back to its original stable condition. Malfunction and/or damage of the speed governor can thereby be prevented, making it possible to provide a speed governor of high reliability having stable performance that is little affected by external disturbances.

Figure 11:
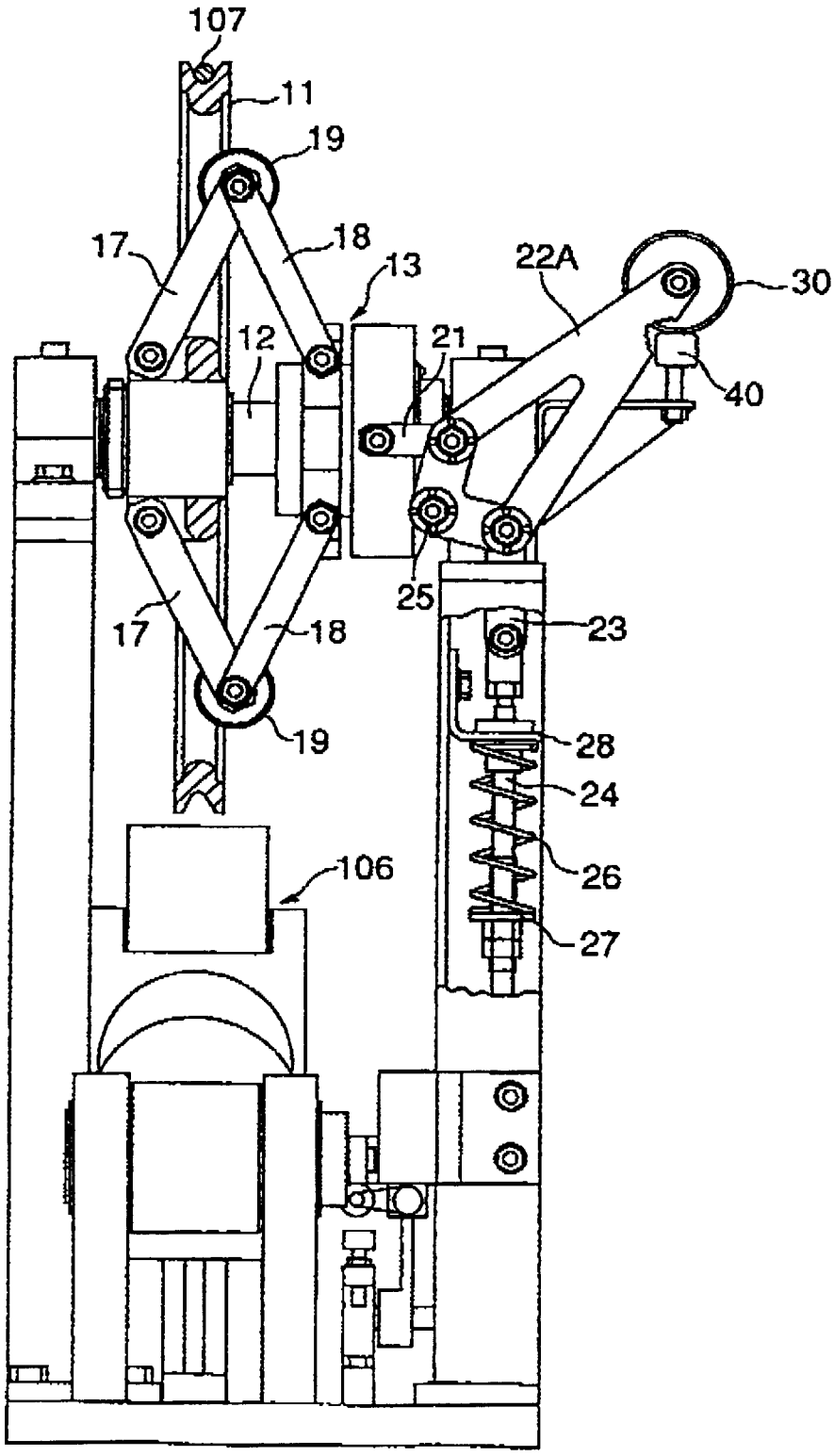
FIG. 11 is a view illustrating a further modified example of the speed governor shown in FIG. 7.

Furthermore, as shown in FIG. 11, suitably a buffer element 40 (made of a resilient body such as rubber and/or an impact absorbing body or damper) may be provided that supports balancing weight 30 in the initial condition (condition in which the speed governor linkage mechanism is not being displaced). When an excessive speed condition of the elevator cage causes the rope clamping element 106 to be actuated, rotation of sheave 8 is brought to an abrupt stop, so the centrifugal force that was acting on rotary weights 19 is also abruptly dissipated. When this happens, the speed governor leakage mechanism is abruptly restored to the initial condition by balancing weight 30 and speed adjustment spring 26, so at this point the speed governor linkage mechanism is subjected to a considerable impact load.

However, if a buffer element 40 is provided, this impact load can be absorbed by balance weight 30, which has the largest inertia, so the impact can be efficiently buffered. The speed governor can thereby be protected, making it possible to provide a speed governor of higher reliability.

[Third Embodiment]

Next, a third embodiment will be described with reference to FIG. 12. The construction of balancing weight 30 and its mounting structure are different in the case of the third embodiment from those of the second embodiment shown in FIG. 7, but the present embodiment is otherwise the same as the second embodiment shown in FIG. 7. In the third embodiment, parts which are the same as in the case of the second embodiment shown in FIG. 7 are given the same reference symbols and the description thereof is not repeated.

Figure 12:
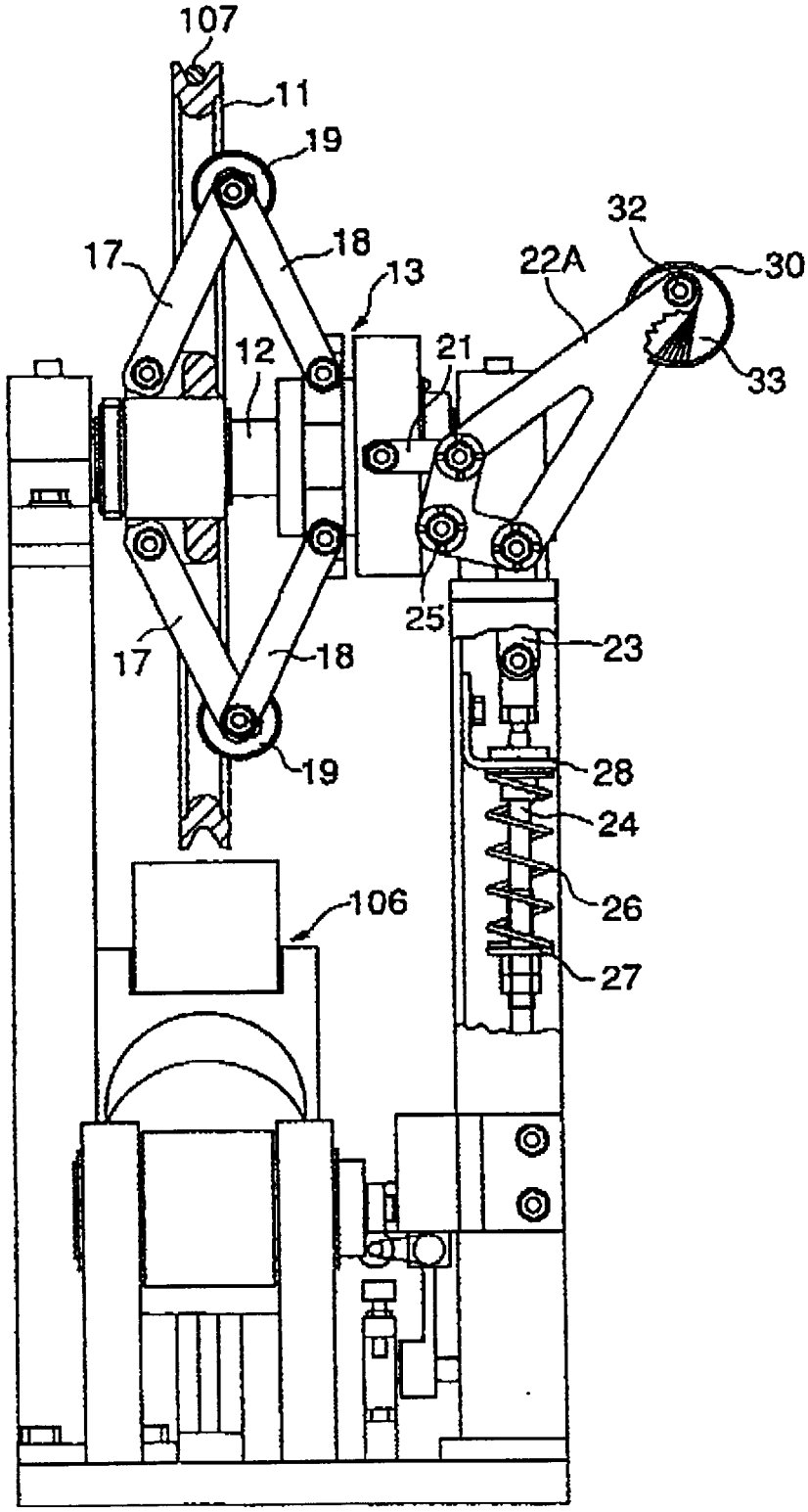
FIG. 12 is a view illustrating a third embodiment of an elevator speed governor according to the present invention.

In the present embodiment, as shown in FIG. 12, balancing weight 30 is rotatably mounted on an arm 22A by means of a shaft 32 at a position offset from the center of gravity of balancing weight 30. A plurality of adjustment lines 33 are marked on the side face of balancing weight 30. The condition of the speed governor linkage mechanism can be confirmed by matching one or other of the adjustment lines of the plurality of adjustment lines 33 with the edge of arm 22A.

Specifically, since balancing weight 30 is mounted in a rotatable condition on shaft 32, the center of gravity of balancing weight 30 is always positioned directly below a fixed point (shaft 32) of balancing weight 30. Consequently, so long as the speed governor is arranged horizontally, the adjustment condition of the speed governor linkage mechanism can be confirmed by confirming which adjustment line 33 the edge of arm 22A coincides with.

Consequently, by employing adjustment lines 33, adjustment of the speed governor linkage mechanism can easily be performed without measuring the angles or dimensions of the various members constituting the speed governor linkage mechanism. Ease of performance of the adjustment task during installation of the speed governor etc can thereby be improved.

Also, since it is possible to judge at a glance whether anything has gone wrong with the speed governor linkage mechanism due to passage of time or other reasons, readjustment can easily be performed. As a result, not only can maintainability of the speed governor be improved but also reliability of the speed governor can be improved.

[Fourth Embodiment]

Figure 13:
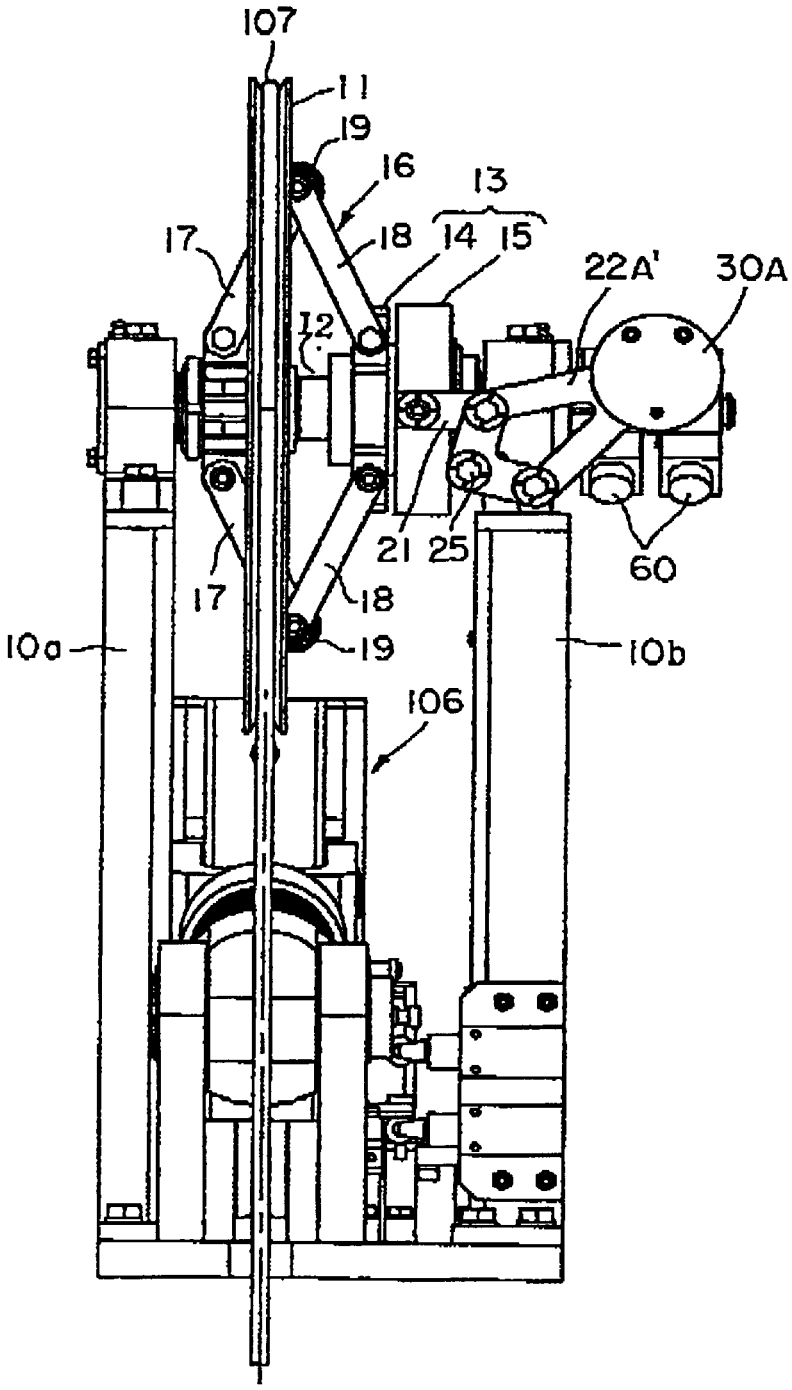
FIG. 13 is a side view of a fourth embodiment of an elevator speed governor according to the present invention.
Figure 14:
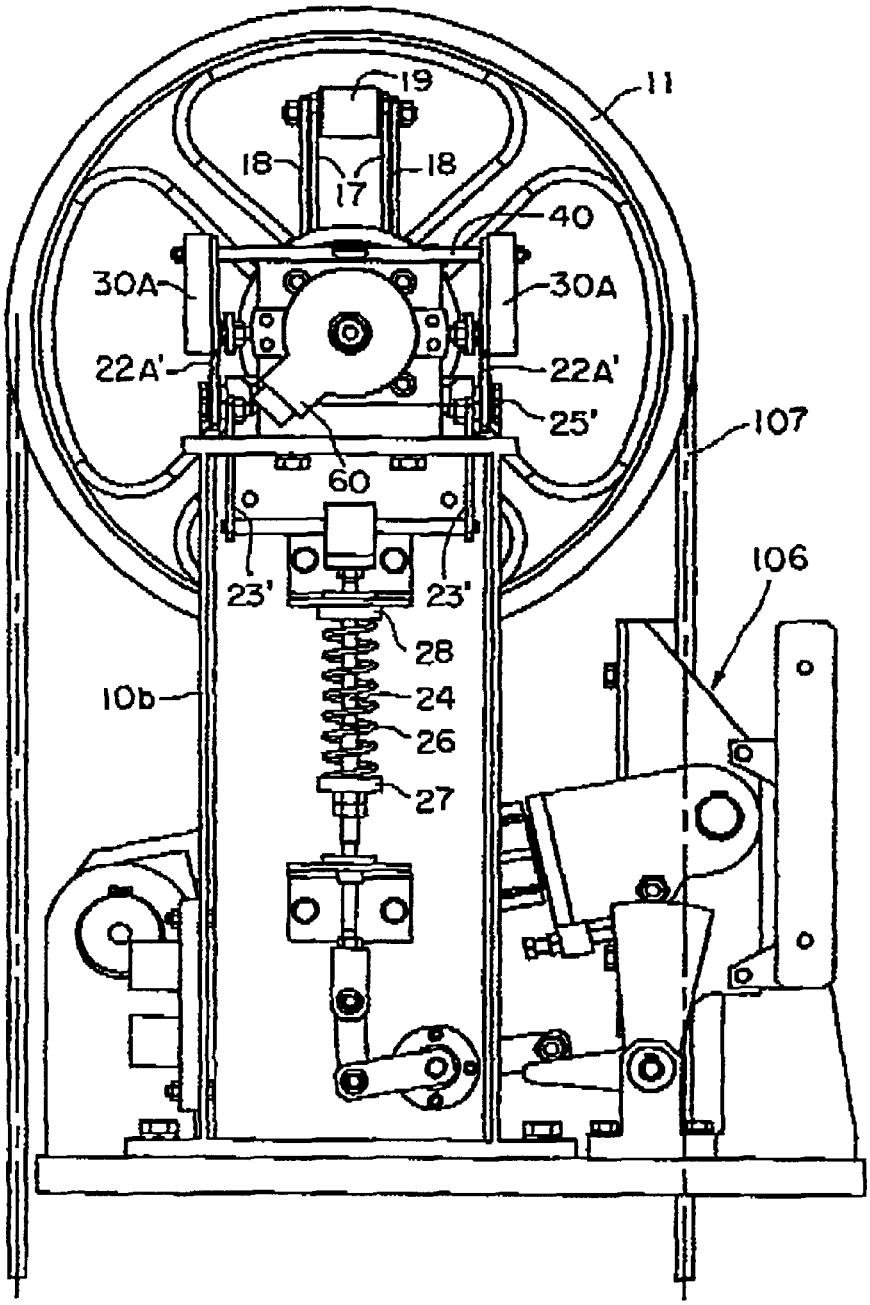
FIG. 14 is a front view of the fourth embodiment of an elevator speed governor according to the present invention.

Next, a fourth embodiment of the present invention will be described with reference to FIG. 13 and FIG. 14. In the fourth embodiment, the balance weight 30 in the second embodiment shown in FIG. 7 is divided into two i.e. is converted into a pair of balance weights 30A. These two balance weights 30A are arranged in symmetrical positions with respect to the perpendicular plane passing through rotary shaft 12. With the provision of two balance weights, two in each case of arms 21, 22A' and 23', which were provided singly in each case in the second embodiment, are now provided. In FIG. 13 and FIG. 14 shown in the present embodiment, the respective reference symbols 21, 22A' and 23' are attached to the arms corresponding to arms 21, 22A' and 23' of the second embodiment. These arms 21, 22A' and 23' are arranged in positions that are symmetrical with respect to the vertical plane passing through rotary shaft 12. As shown in FIG. 14, balance weights 30A are arranged on the outside of arm 22A' so that a sufficient separation is thereby ensured between the pair of arms 22A'. Between the pair of arms 22A', there is arranged an encoder 60 for detecting the position of the cage that is connected co rotary shaft 12. The two balance weights 30A are coupled by means of a connecting rod 40. Connecting rod 40 connects the two balance weights 30A in a position such that there is no interference with encoder 60 irrespective of the position of arms 22A'.

Since, in the present embodiment, balance weights 30A are arranged in divided fashion, a space wherein components can be arranged on the line of extension of rotary shaft 12 can be secured, making it possible to construct the speed governor in compact fashion by arranging components in this space. In particular, in the present embodiment, an encoder 60 which it is desirable to connect with rotary shaft 12 in the aforesaid space is arranged therein, so the technical effects of this are outstanding.

Also, in the present embodiment, since the pair of balance weights 30A are coupled through connecting rod 40, the position of the center of gravity of the assembly comprising balance weights 30A and connecting rod 40 can be arranged on a vertical plane passing through rotary shaft 12. Furthermore, balance weights 30A, arms 21, 22A' and 23' are arranged in symmetrical positions with respect to the perpendicular plane passing through rotary shaft 12. The linkage mechanism can thereby be operated in a more stable fashion.

As described above, the speed governor and elevator using the speed governor according to the present invention, a horizontal type speed governor of stable performance can be obtained.

Obviously, numerous additional modifications and variations of the present invention are possible in light of the above teachings. It is therefore to be understood that within the scope of the appended claims, the present invention may be practiced otherwise than as specially described herein.

What is claimed is:

1. An elevator speed governor comprising:

(a) a rope clamping element capable of gripping a speed governor rope for actuating an emergency stop device provided on a cage of an elevator;

(b) a sheave that rotates with a speed corresponding to a speed of said cage, being engaged by said speed governor rope;

(c) a rotary weight that rotates about an axis of rotation directed horizontally, being linked with rotation of said sheave and that is displaced by centrifugal force so as to move away from said axis of rotation;

(d) a speed governor linkage mechanism on which said rotary weight is mounted and that is moved with displacement of said rotary weight and that actuates said rope clamping element if a movement exceeds a prescribed range;

(e) a speed adjustment mechanism provided in said speed governor linkage mechanism, that is displaced with movement of said speed governor linkage mechanism and that generates a first balancing force that restrains movement of said speed governor linkage mechanism by resilient force generated in accordance with the amount of said displacement; and (f) a balancing weight provided in said speed governor linkage mechanism and that loads said speed governor linkage mechanism with a second balancing force produced by weight acting on said balancing weight that restrains movement of said speed governor linkage mechanism.

2. The speed governor according to claim 1, wherein if a speed of said cage is less than a prescribed speed, a restraint of movement of said speed governor linkage mechanism is performed solely by said second balancing force and if said speed of said cage is more than or equal to said prescribed speed, a restraint of movement of said speed governor linkage mechanism is performed by both of said second balancing force and said first balancing force.

3. The speed governor according to claim 1, wherein said balancing weight is mounted on said speed governor linkage mechanism such that said second balancing force becomes smaller as an amount of displacement of said speed governor linkage increases.

4. The speed governor according to claim 1, wherein said balancing weight is formed to be hollow, being capable of accommodating an object in an interior of said balancing weight.

5. The speed governor according to claim 1, further comprising a buffer element provided in a position in which said balancing weight is present when said speed governor linkage mechanism is not displaced;

said balancing weight being supported by said buffer element when said balancing weight is tending to return to an initial position on stoppage of said sheave by actuation of said rope clamping element.

6. The speed governor according to claim 1, wherein said balancing weight is mounted on said speed governor linkage mechanism in a position offset from a center of gravity, means for displaying an inclination of said balancing weight being provided on said balancing weight.

7. An elevator speed governor comprising:

(a) a rope clamping element capable of gripping a speed governor rope for actuating an emergency stop device provided on a cage of an elevator;

(b) a sheave that rotates with a speed corresponding to a speed of said cage, being engaged by said speed governor rope;

(c) a rotary weight that rotates about an axis of rotation directed horizontally, being linked with rotation of said sheave and that is displaced by centrifugal force so as to move away from said axis of rotation;

(d) a speed governor linkage mechanism on which said rotary weight is mounted and that is moved with displacement of said rotary weight and that actuates said rope clamping element if a movement exceeds a prescribed range;

(e) a speed adjustment mechanism provided in said speed governor linkage mechanism, that is displaced with movement of said speed governor linkage mechanism and that generates a first balancing force that restrains movement of said speed governor linkage mechanism by resilient force generated in accordance with the amount of said displacement;

(f) a balancing weight provided in said speed governor linkage mechanism and that loads said speed governor linkage mechanism with a second balancing force produced by weight acting on said balancing weight that restrains movement of said speed governor linkage mechanism; and (g) a linkage member that couples said balancing weight in a middle, said balancing weight being divided into a plurality.

8. An elevator comprising:

(1) a cage that ascends and descends guided by a guide rail within a shaft;

(2) a speed governor rope that moves linked with movement of said cage;

(3) a speed governor having a sheave that is engaged by said speed governor rope, said speed governor comprising:

(a) a rope clamping element capable of gripping a speed governor rope for actuating an emergency stop device provided on a cage of an elevator;

(b) a sheave that rotates with a speed corresponding to a speed of said cage, being engaged by said speed governor rope;

(c) a rotary weight that rotates about an axis of rotation directed horizontally, being linked with rotation of said sheave and that is displaced by centrifugal force so as to move away from said axis of rotation;

(d) a speed governor linkage mechanism on which said rotary weight is mounted and that is moved with displacement of said rotary weight and that actuates said rope clamping element if a movement exceeds a prescribed range;

(e) a speed adjustment mechanism provided in said speed governor linkage mechanism, that is displaced with movement of said speed governor linkage mechanism and that generates a first balancing force that restrains movement of said speed governor linkage mechanism by resilient force generated in accordance with the amount of said displacement; and (f) a balancing weight provided in said speed governor linkage mechanism and that loads said speed governor linkage mechanism with a second balancing force produced by weight acting on said balancing weight that restrains movement of said speed governor linkage mechanism; and (4) an emergency stop device provided on said cage and that stops said cage by gripping said guide rail when a rope clamping element of said speed governor is actuated.

* * * * *